US009679540B2

(12) United States Patent
Anupongongarch et al.

(10) Patent No.: US 9,679,540 B2
(45) Date of Patent: Jun. 13, 2017

(54) TERNARY ADDRESSABLE SELECT SCANNER

(71) Applicant: Kopin Corporation, Westborough, MA (US)

(72) Inventors: Pin Anupongongarch, Shrewsbury, MA (US); Frederick P. Herrmann, Sharon, MA (US)

(73) Assignee: KOPIN CORPORATION, Westborough, MA (US)

( * ) Notice: Subject to any disclaimer, the term of this patent is extended or adjusted under 35 U.S.C. 154(b) by 0 days.

(21) Appl. No.: 14/877,152

(22) Filed: Oct. 7, 2015

(65) Prior Publication Data

US 2016/0125852 A1 May 5, 2016

Related U.S. Application Data

(60) Provisional application No. 62/069,973, filed on Oct. 29, 2014.

(51) Int. Cl.

| | |
|---|---|
| ***G09G 5/00*** | (2006.01) |
| ***G09G 5/39*** | (2006.01) |
| ***G09G 3/36*** | (2006.01) |

(52) U.S. Cl.

CPC ..... *G09G 5/39* (2013.01); *G09G 3/3677* (2013.01); *G09G 5/006* (2013.01); *G09G 2310/0202* (2013.01); *G09G 2310/0205* (2013.01); *G09G 2310/0232* (2013.01); *G09G 2340/0414* (2013.01)

(58) Field of Classification Search

None

See application file for complete search history.

(56) References Cited

U.S. PATENT DOCUMENTS

| | | | | |
|---|---|---|---|---|
| 5,920,886 | A * | 7/1999 | Feldmeier | G06F 17/30982 365/168 |
| 6,133,754 | A * | 10/2000 | Olson | H03K 19/09425 326/112 |
| 6,300,924 | B1 | 10/2001 | Markandey et al. | |
| 6,330,010 | B1 * | 12/2001 | Nason | G09G 1/16 715/802 |
| 6,515,679 | B1 * | 2/2003 | Igarashi | G09G 3/3648 345/698 |

(Continued)

FOREIGN PATENT DOCUMENTS

| | | |
|---|---|---|
| WO | WO 2006/038187 | 4/2006 |
| WO | WO 2014/010313 | 1/2014 |
| WO | WO 2016/069228 | 5/2016 |

OTHER PUBLICATIONS

International Search Report and Written Opinion for PCT/US2015/054482 dated Jan. 18, 2016 entitled "Ternary Addressable Select Scanner".

*Primary Examiner* — Joni Richer

(74) *Attorney, Agent, or Firm* — Hamilton, Brook, Smith & Reynolds, P.C.

(57) ABSTRACT

A method of writing image data to a pixel array includes decoding an address and activating, based on the decoded address, two or more row selection signals. The address may be a ternary address having at least one trit. The method further includes providing the two or more row selection signals to the pixel array to select two or more rows of the pixel array, the activation of which writes the image data to pixels in the two or more rows of the pixel array.

18 Claims, 6 Drawing Sheets

(56) References Cited

U.S. PATENT DOCUMENTS

| | | | | |
|---|---|---|---|---|
| 2002/0145580 | A1* | 10/2002 | Waterman | G09G 3/3648 345/89 |
| 2003/0169247 | A1 | 9/2003 | Kawabe et al. | |
| 2013/0120465 | A1* | 5/2013 | Govil | G09G 3/2074 345/690 |

* cited by examiner

TERNARY ADDRESSABLE SELECT SCANNER

RELATED APPLICATION

This application claims the benefit of U.S. Provisional Application No. 62/069,973, filed on Oct. 29, 2014, the entire teachings of which are incorporated by reference herein.

BACKGROUND OF THE INVENTION

Vertical scanning of an LCD (Liquid Crystal Display) relates to providing image data to an LCD pixel array. Vertical scan rate refers to the number of times, per unit time, that an LCD pixel array is refreshed (i.e., redrawn). Vertical scanning can be implemented with a shift register-based scanner or an addressable scanner.

A shift register-base scanner selects each row sequentially, from top-to-bottom or from bottom-to-top. The order of the row selection does not change—only the direction of the sequential section may change.

An addressable scanner provides more flexibility with image construction, since each row can be selected independently. This feature allows the LCD to do a "line copying" function, in which the video data on one row can be "copied" to other rows in a short period of time. This is useful when the same data is to be written, within tight timing constraints, to many rows.

The copying function relies on storing the video voltage on the column capacitance, and turning on the copied rows one-by-one. Due to leakage that may be associated with the column capacitance, the stored video voltage may change over the time it takes to write to multiple rows. Such a voltage change may result in the rows that are copied later appearing lighter than the rows that are copied earlier.

SUMMARY OF THE INVENTION

The described embodiments combine the LCD row addressable driving scheme described above with ternary addressing, which allows multiple rows to be turned on at one time. This feature facilitates writing the same data to multiple rows simultaneously. Each row completes the horizontal scanning, and the rows have the same voltage and no difference in appearance.

In one aspect, the invention is a method of writing image data to a pixel array, including decoding an address and activating, based on the decoded address, two or more row selection signals. The address may be a ternary address having at least one trit. The decoding may be performed by a row selection decoder. The method may further include providing the two or more row selection signals to the pixel array to select two or more rows of the pixel array, the activation of which writes the image data to pixels in the two or more rows of the pixel array.

One embodiment further includes preventing the at least one trit from occupying the least significant bit position of the address. Another embodiment further includes using the image data for one or more border rows of an image to be displayed on the pixel array.

In one embodiment, the image is an inset image of a first resolution to be instantiated within an pixel array having a second resolution. The second resolution may be greater than the first resolution. In another embodiment, the image data depicts black border rows of the image.

One embodiment further includes writing the one or more border rows of the image during a vertical retrace time associated with the image to be displayed on the pixel array.

Another embodiment further includes providing mask information associated with at least one bit position of the address, wherein the masking data indicates which one of either a binary input or a trit occupies the bit position of the address.

In one embodiment, when the masking data is in a first state, the binary input occupies the bit position of the address, and when the masking data is in a second state, the trit occupies the bit position of the address. In another embodiment, the masking data indicates two or more bit positions of the address separately, such that the masking data specifies each bit position independent of other bit positions. In yet another embodiment, the masking data indicates two or more bit positions of the address with a common indication, such that the common indication specifies all of the two or more bit positions as being the same.

In another aspect, the invention is an apparatus for displaying an image, including a pixel array, a row selection decoder configured to decode an address and activate, based on the decoded address, two or more row selection signals, the address being a ternary address having at least one trit. The two or more row selection signals may be provided to the pixel array to select two or more rows of the pixel array, the selection of which writes the image data to pixels in the two or more rows of the pixel array.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

Figure 1:
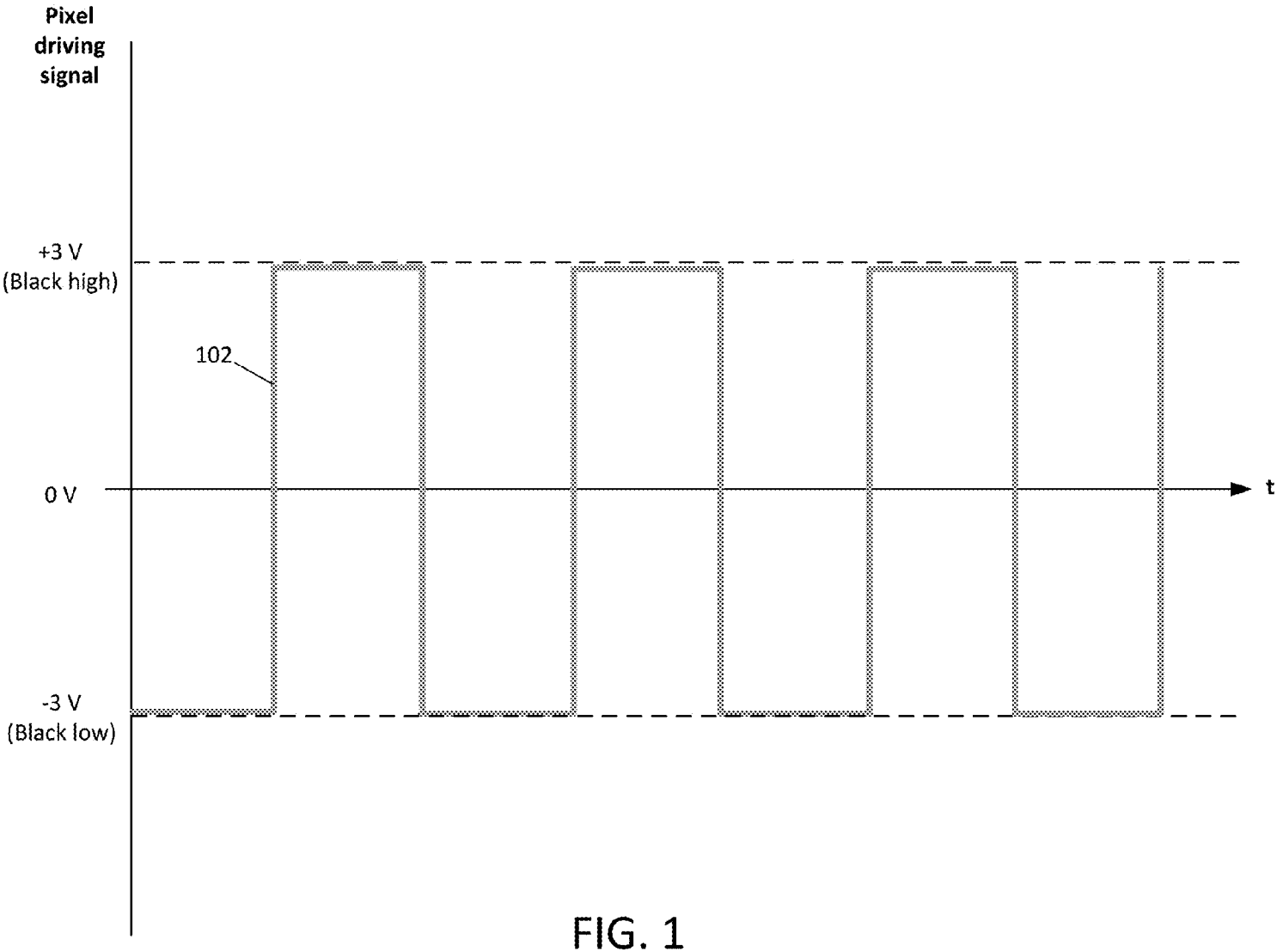
FIG. 1 shows an example alternating LCD pixel voltage that may produce a black or dark pixel

A description of example embodiments of the invention follows.

Recently developed micro-displays can provide large-format, high resolution color pictures and streaming video in a very small form factor. One application for such displays can be integrated into a wireless headset computer worn on the head of the user with a display within the field of view of the user, similar in format to eyeglasses, audio headset or video eyewear. A "wireless computing headset" device includes one or more small high-resolution micro-displays and optics to magnify the image. The WVGA micro-displays can provide super video graphics array (SVGA) (800×600) resolution or extended graphic arrays (XGA) (1024×768) or even higher resolutions. A wireless computing headset contains one or more wireless computing and communication interfaces, enabling data and streaming video capability, and provides greater convenience and mobility through hands dependent devices. For more information concerning such devices, see patent applications entitled "Mobile Wireless Display Software Platform for Controlling Other Systems and Devices," U.S. application Ser. No. 12/348,648 filed Jan. 5, 2009, "Handheld Wireless Display Devices Having High Resolution Display Suitable For Use as a Mobile Internet Device," PCT International Application No. PCT/US09/38601 filed Mar. 27, 2009, and "Headset Computer (HSC) As Auxiliary Display With ASR and HT Input," U.S. application Ser. No. 13/799,570 filed Mar. 13, 2013, each of which are incorporated herein by reference in their entirety.

To provide flexibility with image construction, vertical scanning for a microdisplay may be performed with the fully-addressable row selection technique described herein. Each pixel row of the microdisplay may be represented by a binary address. The row address bits may be shifted in serially during the previous row and are decoded to turn on the associated row in the vertical select scanner.

One application of the row addressable scheme is "line copying," which enables the microdisplay to operate with video formats smaller than the native resolution of the microdisplay. When the smaller video format image is centered in the microdisplay, a certain number of unused pixels will exist above and below the image, and at the left and right borders of the image. The unused pixels are driven to black, to create a black border about the perimeter of the image.

The left and right black borders may be generated by including black pixels in the input video stream, while the display's line copying feature supports an efficient method to generate top and bottom black borders. As described elsewhere herein, line copying refers to taking the video data from one row of the microdisplay, and duplicating that video data on one or more other rows. A line copy operation can be accomplished in less than the normal horizontal scan time, because it is not necessary to scan in the complete line.

In line copying mode, the horizontal scanning circuits are disabled and the video data of the previous row is preserved on the column line capacitances. The address decoder and row selection operate normally to transfer the stored data to the pixels of the selected rows.

Row Inversion

For an LCD display, high transmission (i.e., a light or white appearance) occurs with zero voltage applied to an LCD pixel and low transmission (i.e., a dark or black appearance) with either positive or negative voltage applied to the pixel. Therefore, an LCD pixel may be driven to black by applying either a positive or negative voltage to the LCD pixel.

Generally, LCD displays do not work well with direct current (DC) voltages. Driving an LCD display pixel at a steady state non-zero DC voltage may damage the display pixel by, for example, causing contaminants to plate on one side or the other of the associated LC cell. In order to prevent damage, the voltage applied to the LCD is generally alternated (i.e., flipped back and forth) between high-black and low-black, to preserve a DC voltage on the pixel that is at or near zero when averaged over time. FIG. 1 illustrates an example alternating LCD pixel voltage signal 102 that could produce a black or dark pixel. In this example, a square wave is shown, although other alternating waveforms may also be used. Preserving a time-average zero voltage on an LCD pixel may be referred to as "establishing DC restore."

Figure 2:
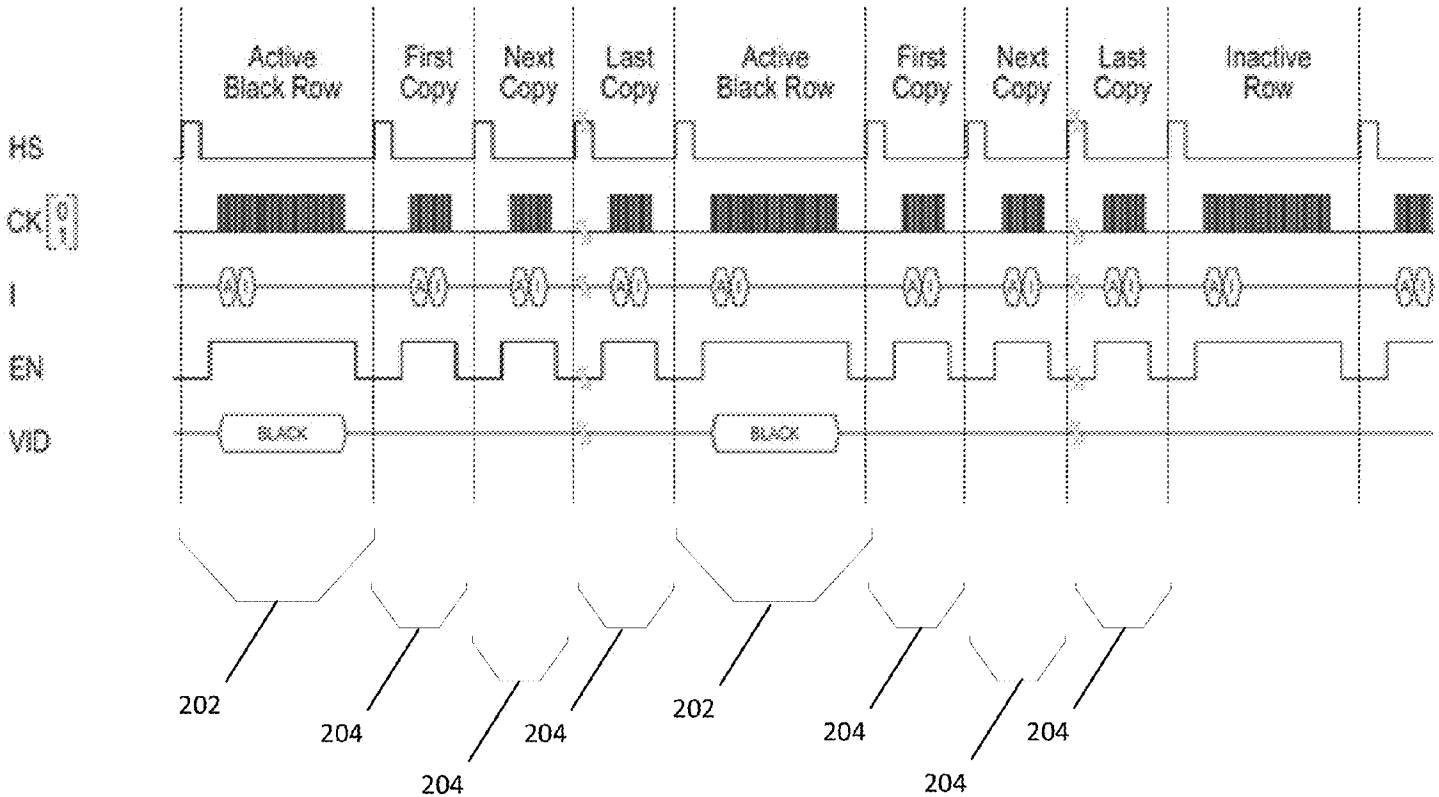
FIG. 2 illustrates how a line copy feature may be used to quickly write multiple black lines.

One way to establish DC restore is to use a row inversion scheme, in which each row exhibits a polarity opposite that of the adjacent rows. The polarity must also be inverted with each frame. FIG. 2 illustrates how the line copy feature may be used to quickly write multiple black lines. After writing a black line with the normal timing 202 for active rows, several copy operations are performed with short row timing 204. These copied rows will all have the same polarity, so they are spaced apart by an even number of rows to preserve row inversion. Another set of black rows may then be written with the opposite polarity, followed by another sequence of copy operations.

Ternary Logic

Ternary logic is an extension of binary Boolean logic. A ternary digit (also referred to herein as a "trit") is used to specify the allowed states of a binary Boolean variable. The trit "X" indicates that the bit can be either a binary 0 or a binary 1. The following example shows the differences between binary addressing and ternary addressing.

A binary address encodes a single value, as shown below:

0000→0

0001→1

0010→2

0011→3

A ternary address, on the other hand, encodes sets of values

00X0→0000, 0010→{0, 2}

X0X1→0000, 0010, 1000, 1010→{1, 3, 9, 11}

As the example above demonstrates, it is possible to represent a set of values using a single ternary address. When each value designates a row of an LCD array, a single ternary address may be used to designate a set of LCD rows. The size of a ternary set is equal to $2^N$, where N is the number of X's (i.e., trits) in the ternary address.

Selection of Multiple Rows Using Ternary Addressing

In a standard row addressing scheme, a row address input to the address decoder turns on one particular row of the display, one row at a time. Combining the row addressable scheme and ternary logic allows multiple rows to be selected with one input address. In ternary addressable scheme, a ternary address with trits is sent to the decoder, resulting in a set of row designations that will turn on multiple rows simultaneously.

The number of trits in the input ternary address depends on the number of rows to be selected. For example, if two rows are to be selected simultaneously, the ternary address will contain one trit. If four rows are to be selected simultaneously, the ternary address will contain two trits.

LCD row inversion scheme (described above) requires that even and odd rows have opposite polarity. Therefore, a trit cannot be in the LSB position of the ternary row address. This allows adjacent rows to have alternate polarity.

The multiple row selection by ternary addressing can be applied to displays of any resolution (the resolution determines the number of bits in the row address). The following example demonstrates multi-row selection with a 4-bit address.

$A_3A_2A_1A_0$ represents an example input address. Any bit can be replaced with a trit except for the LSB ($A_0$), which needs to remain a purely binary value to enable the row inversion capability. With one trit at $A_1$, the ternary address is $A_3A_2X_1A_0$. Each address represents a set of two rows that will turn on simultaneously, as shown in Table 1.

TABLE 1

| A3 | A2 | X1 | A0 | Row Set |
|---|---|---|---|---|
| 0 | 0 | X | 0 | {0, 2} |
| 0 | 0 | X | 1 | {1, 3} |
| 0 | 1 | X | 0 | {4, 6} |
| 0 | 1 | X | 1 | {5, 7} |
| 1 | 0 | X | 0 | {8, 10} |
| 1 | 0 | X | 1 | {9, 11} |
| 1 | 1 | X | 0 | {12, 14} |
| 1 | 1 | X | 1 | {13, 15} |

With two Xs at $A_1$ and $A_2$ positions, the ternary address is $A_3X_2X_1A_0$. Each address represents a set of four rows that will turn on simultaneously, as shown in Table 2.

TABLE 2

| A3 | X2 | X1 | A0 | Row Set |
|---|---|---|---|---|
| 0 | X | X | 0 | {0, 2, 4, 6} |
| 0 | X | X | 1 | {1, 3, 5, 7} |
| 1 | X | X | 0 | {8, 10, 12, 14} |
| 1 | X | X | 1 | {9, 11, 13, 15} |

Figure 3:
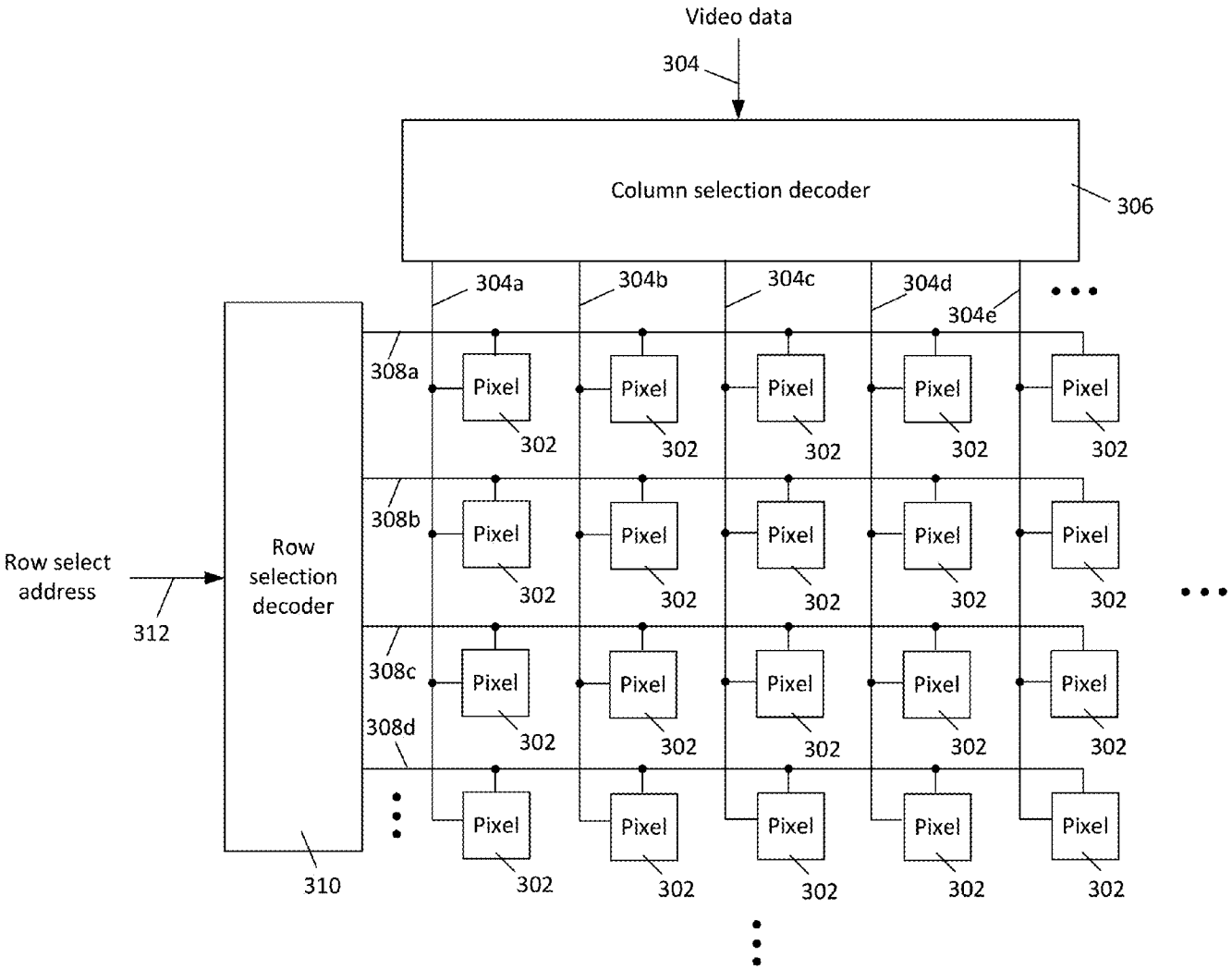
FIG. 3 is a simple example, according to one embodiment of the invention, of an array of pixels.

FIG. 3 illustrates a simple example, according to one embodiment of the invention, of an array of pixels 302, to which video data signals 304*a* through 304*e* is presented by column selection decoder 306 and to which row selection signals 308*a* through 308*d* are presented by row selection decoder 310. It should be understood that while only five video data signals 304*a* through 304*e* are shown for this example, the column selection decoder 306 may generate more video data signals in other embodiments. Likewise, while only four row selection signals 308*a* through 308*d* are shown for this example, the row selection decoder 310 may generate more row selection signals in other embodiments.

In one embodiment, the Row selection decoder 310 and the column selection decoder may be implemented by hardware logic, e.g., on an integrated circuit or gate array, or in encoded logic, or by other techniques known in the art for implementing a decoder.

The row selection decoder 310 receives row select address 312, and decodes the row select address 312 to activate one or more of the row selection signals 308*a* through 308*d*. The selection signals facilitate writing the video data 304*a* through 304*e* to selected rows of pixels 302. When a particular selection signal is activated, that signal causes the associated video data to be stored on a storage element (e.g., a capacitor) within the pixel.

The row selection decoder 310 may decode a purely binary value of the row select address 312 to select one of the row selection signals 308. For example, a row select address of 0000 may select row selection signal 308*a*, a row select address of 0001 may select row selection signal 308*b*, a row select address of 0010 may select row selection signal 308*c*, and a row select address of 0011 may select row selection signal 308*d*.

The row selector 310 may decode a ternary value of the row select address 312 to simultaneously select two or more of the row selection signals 308*a* through 308*d*, as described herein in the examples depicted in Table 1 and Table 2. The row selector 310 interprets a trit in a position of the ternary row select address 312 as being both binary states in that position simultaneously, thus designating multiple row selections. As described herein, a trit in one position of the row select address 312 designates two row selections, a trit in each of two positions of the address designates four row selections, a trit in each of three positions of the address designates eight row selections and so on.

Inset Image Applications

In many cases of display operation, rows are selected sequentially from top to bottom or bottom to top, with some number of inactive rows during a vertical retrace interval. An inset image can be used for a display to operate with video formats smaller than its native resolution, while the border is written to black. In such operation, a fixed number of unused lines must fit into the smaller retrace time of the small video format.

Figure 4:
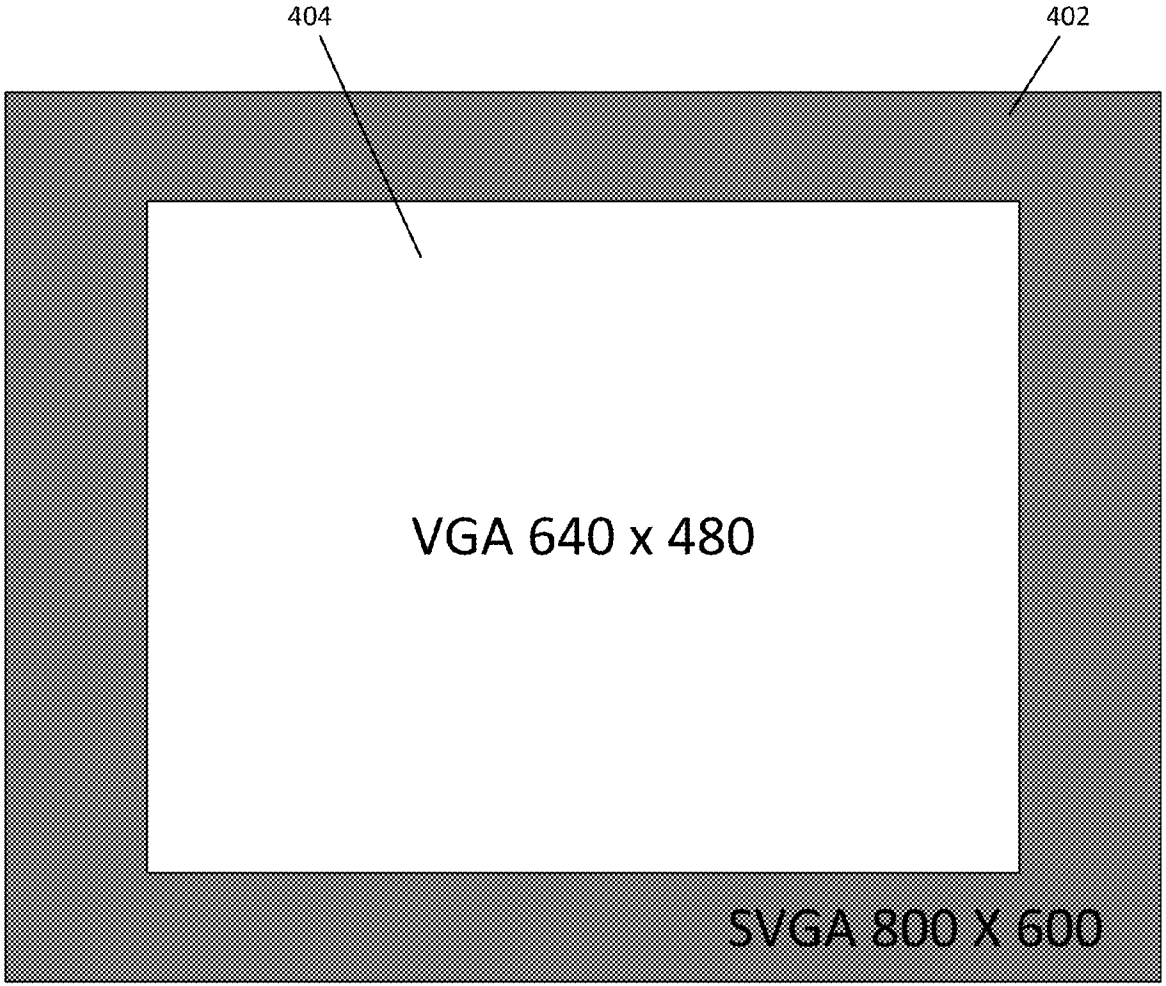
FIG. 4 is a SVGA display with a VGA inset image.
Figure 5:
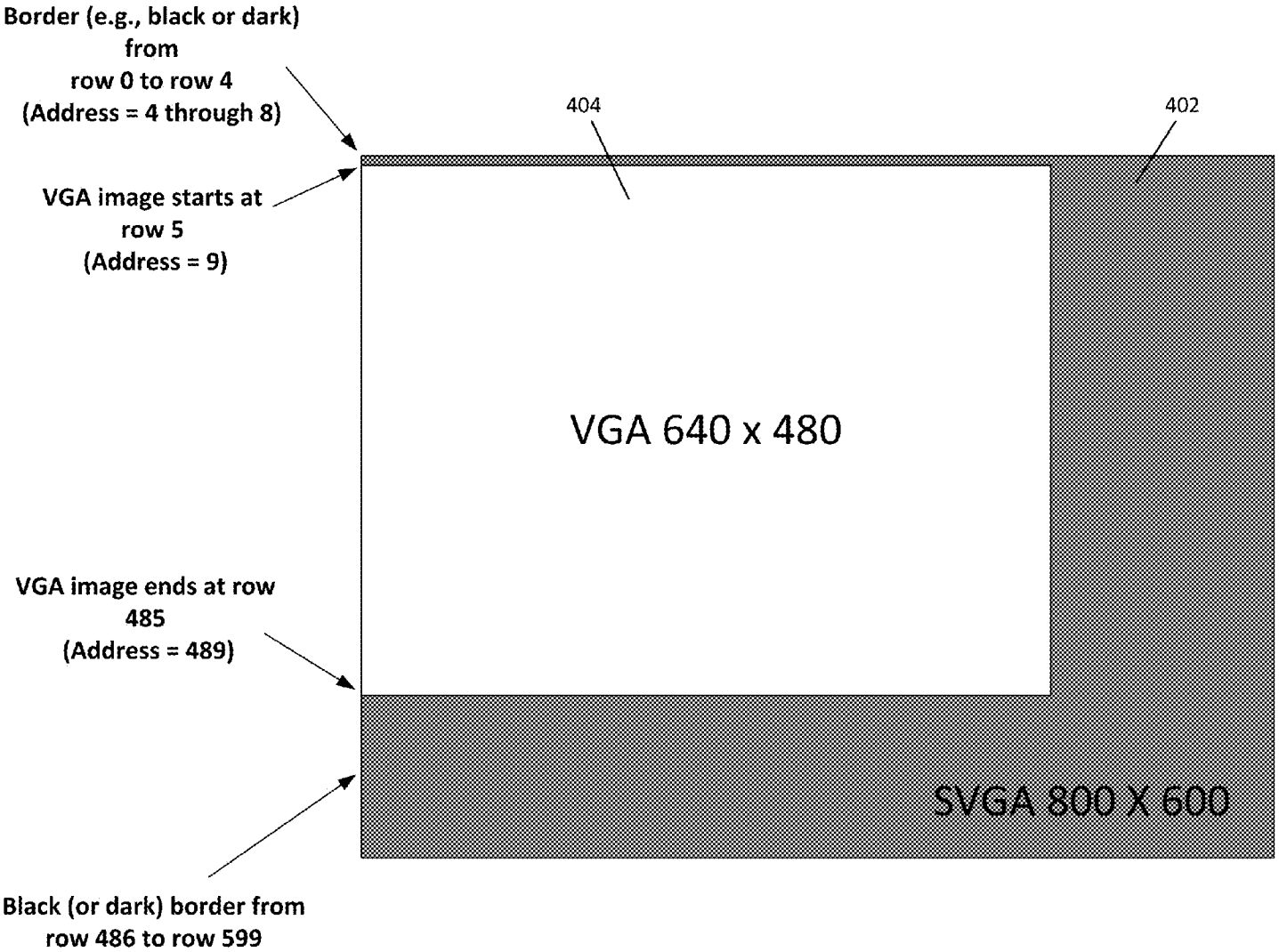
FIG. 5 is a SVGA display similar to the display shown in FIG. 3, with the VGA inset image situated in a different position within the SVGA display.

Consider the following example of an SVGA 402 (800×600) display with a VGA 404 (640×480) video input operating in row inversion, shown in FIG. 4. The VGA inset image is surrounded by black borders on all sides. The inset image may also move around with different sized borders on top and bottom, as shown in the example of FIG. 5.

The 60 Hz VESA VGA format requires 45 lines of vertical retrace. The 120 unused lines (i.e., the top and bottom borders) need to fit into 45 VGA lines time.

There are two ways to achieve this. First, as described above, the unused lines can be written individually, but in less than the native row time, using the line copying function. Second, the unused lines can be written simultaneously in the native row time.

Using the line copying approach, a group of four unused rows can be written to black within 1.5 times the native VGA row time. With the inversion constraint, the rows in a group have to be spaced apart by an even number of rows, so that alternate rows can have opposite polarity. The first row of a group is written black in a full row time—that row completes the horizontal scanning. The remaining three rows are copied with only 17 percent of the full row time.

One drawback of the line copying approach is that the copying function relies on storing the video voltage on the column capacitance, and that the rows are turned on (i.e., written) one by one. Any drop of the video voltage, caused by leakage over time, may make the rows that are copied later appear lighter than the rows which are copied earlier.

With the ternary addressing scheme, multiple rows can be written simultaneously in a full native row time. Therefore, each row will complete the horizontal scanning, and the unused rows will have the same voltage and no difference in appearance. To write 120 rows in the 60 Hz VGA VESA retrace time, an unused row needs to be at least 120/45=2.67x shorter than a full row time. An SVGA display can utilize the ternary addressable logic with one or two trits, allowing up to four rows to be selected simultaneously.

Implementation

A 10-bit address is needed for the example display of SVGA up to SXGA resolution. The address is represented by $A_9A_8\ A_7A_6A_5A_4\ A_3A_2A_1A_0$.

One or both of the $2^{nd}$ and $3^{rd}$ LSB positions ($A_2$, $A_1$) may be replaced by trits to enable a selection of a group of two or four rows. Three example ternary configurations are possible:

Example 1: $A_9A_8\ A_7A_6A_5A_4\ A_3A_2X_1A_0$→select two rows at a time, two rows apart Example 2: $A_9A_8\ A_7A_6A_5A_4\ A_3X_2A_1A_0$→select two rows at a time, four rows apart Example 3: $A_9A_8\ A_7A_6A_5A_4\ A_3X_2X_1A_0$→select four rows at a time, two rows apart A mask address is used for the select scanner to recognize the location of Xs in the ternary addresses. A mask bit M can be applied to any bit position in the address, and functions as a selector control to "choose" whether the bit position takes on a particular binary value or a trit. The operation is described in Table 3. When M is 0, the address bit position takes on the value of the input binary address bit A. When M is 1, the address bit position is a trit X.

TABLE 3

| Mask M | Address Bit A | Address Bit Position |
|---|---|---|
| 0 | 0 | 0 |
| 0 | 1 | 1 |
| 1 | 0 | X |
| 1 | 1 | X |

To turn on four rows, for example rows {0, 2, 4, 6}, the binary address input can be any of the four row addresses 0 or 2 or 4 or 6. Mask bits $M_1$ and $M_2$ are applied to $A_1$ and $A_2$, resulting in ternary address 00 0000 0XX0.

TABLE 4

| | bit9 | bit8 | bit7 | bit6 | bit5 | bit4 | bit3 | bit2 | bit1 | bit0 | Value |
|---|---|---|---|---|---|---|---|---|---|---|---|
| Binary Address | 0 | 0 | 0 | 0 | 0 | 0 | 0 | 0 | 0 | 0 | 0 |
| | 0 | 0 | 0 | 0 | 0 | 0 | 0 | 0 | 1 | 0 | 2 |
| | 0 | 0 | 0 | 0 | 0 | 0 | 0 | 1 | 0 | 0 | 4 |
| | 0 | 0 | 0 | 0 | 0 | 0 | 0 | 1 | 1 | 0 | 6 |
| Mask Address | 0 | 0 | 0 | 0 | 0 | 0 | 0 | 1 | 1 | 0 | |
| Ternary Address | 0 | 0 | 0 | 0 | 0 | 0 | 0 | X | X | 0 | {0, 2, 4, 6} |

Masking by a Single Control Bit

For applications that only need a fixed number of multiple-row enables, all the mask bits can be tied to a single control bit M which applies to certain positions in the input row address. Two possible configurations are:

1) Individual row selection with no masking, and

2) Multi-row selection with masking.

For individual row selection, no masking is applied and X1=A1 and X2=A2.

TABLE 5

| Individual row selection | | | | | | | | | | |
|---|---|---|---|---|---|---|---|---|---|---|
| Binary Address | $A_9$ | $A_8$ | $A_7$ | $A_6$ | $A_5$ | $A_4$ | $A_3$ | $A_2$ | $A_1$ | $A_0$ |
| Mask Address | 0 | 0 | 0 | 0 | 0 | 0 | 0 | 0 | 0 | 0 |
| Ternary Address | $A_9$ | $A_8$ | $A_7$ | $A_6$ | $A_5$ | $A_4$ | $A_3$ | $A_2$ | $A_1$ | $A_0$ |

To select four rows at a time with two rows apart (refer to the previously described configuration of Example 3, with a fixed number of four-row enables), mask positions M1 and M2 may be tied together (i.e., M1=M2=M), so that X1 and X2 are both X. The operation can be shown below:

TABLE 6

| Four-row selection | | | | | | | | | | |
|---|---|---|---|---|---|---|---|---|---|---|
| Binary Address | $A_9$ | $A_8$ | $A_7$ | $A_6$ | $A_5$ | $A_4$ | $A_3$ | $A_2$ | $A_1$ | $A_0$ |
| Mask Address | 0 | 0 | 0 | 0 | 0 | 0 | 0 | 1 | 1 | 0 |
| Ternary Address | $A_9$ | $A_8$ | $A_7$ | $A_6$ | $A_5$ | $A_4$ | $A_3$ | X | X | $A_0$ |

Figure 6:
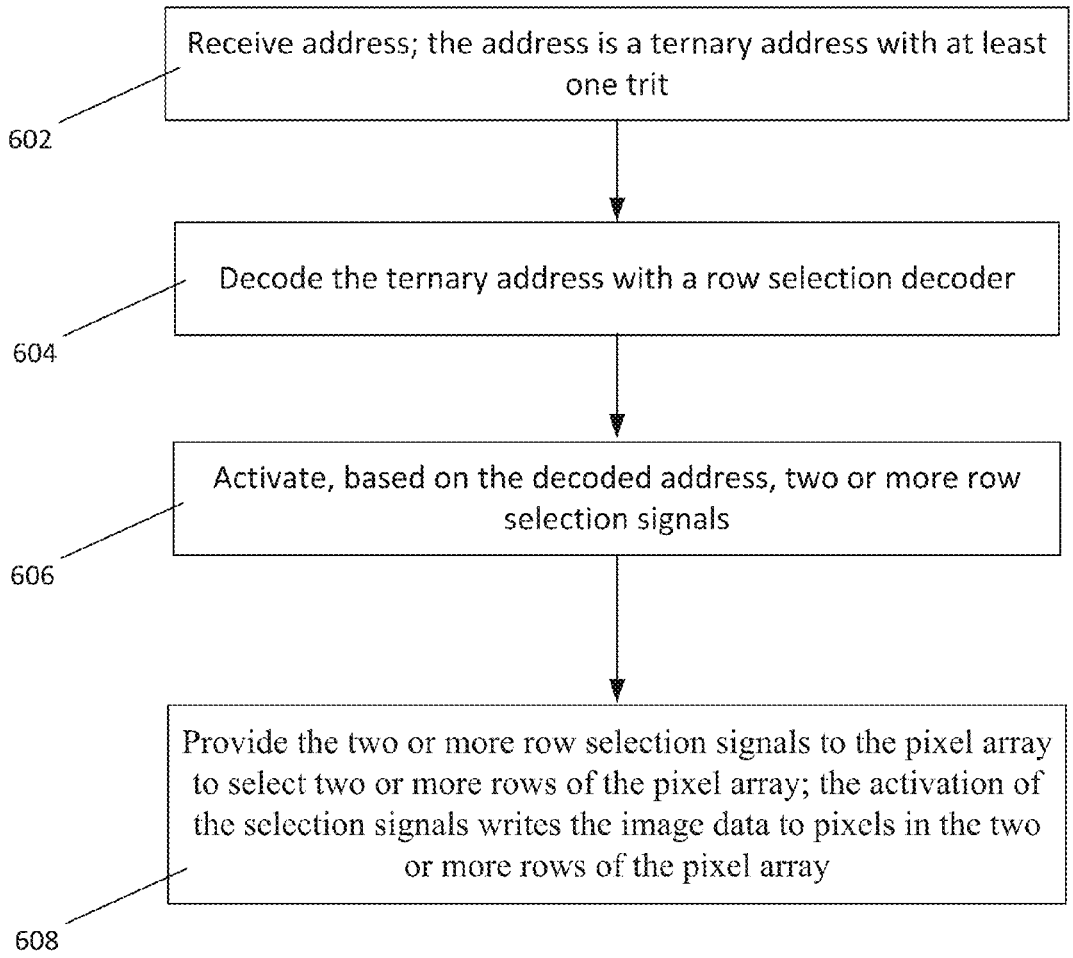
FIG. 6 illustrates one embodiment of a method of writing image data to a pixel array.

FIG. 6 illustrates one embodiment of a method of writing image data to a pixel array. A ternary address with at least one trit is received 602. The address is decoded using a row selection decoder as described herein. The row selection decoder activates 606 two or more row selection signals based on the decoded address. The row selection decoder provides 608 the two or more row selection signals to the pixel array to select two or more rows of the pixel array. The activation of the selection signals writes the image data to pixels in the two or more rows of the pixel array.

While this invention has been particularly shown and described with references to example embodiments thereof, it will be understood by those skilled in the art that various changes in form and details may be made therein without departing from the scope of the invention encompassed by the appended claims.

What is claimed is:

1. A method of writing image data to a pixel array, comprising:

by a row selection decoder, decoding an address and activating, based on the decoded address, two or more row selection signals, the address being a ternary address having at least one trit, the trit designating a place in the address that may take on either one of two binary states;

providing the two or more row selection signals to the pixel array to select two or more rows of the pixel array, the activation of which writes the image data to pixels in the two or more rows of the pixel array; and preventing the at least one trit from occupying a least significant bit position of the address.

2. The method of claim 1, further including using the image data for one or more border rows of an image to be displayed on the pixel array.

3. The method of claim 2, wherein the image is an inset image of a first resolution to be instantiated within a pixel array having a second resolution, the second resolution being greater than the first resolution.

4. The method of claim 2, wherein the image data depicts black border rows of the image.

5. The method of claim 2, further including writing the one or more border rows of the image during a vertical retrace time associated with the image to be displayed on the pixel array.

6. A method of writing image data to a pixel array, comprising:

by a row selection decoder, decoding an address and activating, based on the decoded address, two or more row selection signals, the address being a ternary address having at least one trit, the trit designating a place in the address that may take on either one of two binary states;

providing the two or more row selection signals to the pixel array to select two or more rows of the pixel array, the activation of which writes the image data to pixels in the two or more rows of the pixel array; and providing masking data associated with a bit position of the address, wherein the masking data indicates which one of either a binary input or a trit occupies the bit position of the address.

7. The method of claim 6, wherein when the masking data is in a first state, the binary input occupies the bit position of the address, and when the masking data is in a second state, the trit occupies the bit position of the address.

8. The method of claim 6, wherein the masking data indicates two or more bit positions of the address separately, such that the masking data specifies each bit position independent of other bit positions.

9. The method of claim 6, wherein the masking data indicates two or more bit positions of the address with a common indication, such that the common indication specifies all of the two or more bit positions as being the same.

10. An apparatus for displaying an image, comprising:

a pixel array;

a row selection decoder configured to decode an address and activate, based on the decoded address, two or more row selection signals, the address being a ternary address having at least one trit, the at least one trit designating a place in the address that may take on either one of two binary states, the at least one trit being excluded from a least significant bit position of the address;

the two or more row selection signals provided to the pixel array to select two or more rows of the pixel array, the selection of which writes the image data to pixels in the two or more rows of the pixel array.

11. The apparatus of claim 10, wherein the image data is used for one or more border rows of an image to be displayed on the pixel array.

12. The apparatus of claim 10, wherein the image is an inset image of a first resolution to be instantiated within a pixel array having a second resolution, the second resolution being greater than the first resolution.

13. The apparatus of claim 10, wherein the image data depicts black border rows of the image.

14. The apparatus of claim 10, wherein the selection of two or more rows of the pixel array occurs during a vertical retrace time associated with the image to be displayed on the pixel array.

15. An apparatus for displaying an image, comprising:

a pixel array;

a row selection decoder configured to decode an address and activate, based on the decoded address, two or more row selection signals, the address being a ternary address having at least one trit, the at least one trit designating a place in the address that may take on either one of two binary states;

the two or more row selection signals provided to the pixel array to select two or more rows of the pixel array, the selection of which writes the image data to pixels in the two or more rows of the pixel array; and the row selection decoder is further configured to receive mask information associated with at least one bit position of the address, wherein the masking data indicates which one of either a binary input or a trit occupies the bit position of the address.

16. The apparatus of claim 15, wherein when the masking data is in a first state, the binary input occupies the bit position of the address, and when the masking data is in a second state, the trit occupies the bit position of the address.

17. The apparatus of claim 15, wherein the masking data indicates two or more bit positions of the address separately, such that the masking data specifies each bit position independent of other bit positions.

18. The apparatus of claim 15, wherein the masking data indicates two or more bit positions of the address with a common indication, such that the common indication specifies all of the two or more bit positions as being the same.

* * * * *